United States Patent [19]

Bard

[11] 3,938,267

[45] Feb. 17, 1976

[54] FANCY STITCHERY WORKING FRAME SUPPORT

[76] Inventor: Donald I. Bard, 7901 College Lane, Annandale, Va. 22003

[22] Filed: Sept. 3, 1974

[21] Appl. No.: 502,683

[52] U.S. Cl. ..... 38/102.1; 248/125

[51] Int. Cl.[2] ..... D06C 3/08

[58] Field of Search ..... 38/102–102.91; 160/371–372, 373, 374, 375, 377, 378; 248/121–125, 127, 163, 165, 172; 211/164

[56] References Cited

UNITED STATES PATENTS

| | | | |
|---|---|---|---|
| 3,163,909 | 1/1965 | Williams | 248/124 X |
| 3,389,882 | 6/1968 | Schlosser | 248/165 X |
| 3,774,325 | 11/1973 | Johnson et al. | 248/122 X |

*Primary Examiner*—Geo. V. Larkin

*Attorney, Agent, or Firm*—A. Yates Dowell, Jr.

[57] ABSTRACT

An apparatus for supporting a needlework frame in a plurality of adjustable positions. The apparatus includes a pair of upright posts which may be located at opposite ends of the working frame or may be located at one end with the working frame cantilevered therefrom.

12 Claims, 8 Drawing Figures

FIG. 4

F

FANCY STITCHERY WORKING FRAME SUPPORT

BACKGROUND OF THE INVENTION

1. Field of the Invention

This invention relates generally to supports of various kinds and relates particularly to supports for adjustably mounting a needlework frame in a plurality of positions.

2. Description of the Prior Art

Heretofore many efforts have been made to provide a support for a needlework frame of the type used in embroidery, crewel, needlepoint, rug hooking and other fancywork in which the working frame has mounted thereon at least a segment of a base material such as lightweight canvas, burlap, warp cloth, or the like. Many of these frames, such as embroidery hoops or narrow panel frames, have been designed to be held in one hand while the stitchery was done with the other hand. These frames, however, restrict the stitchwork to a one-hand operation which can become both tiring and uncomfortable.

Other frames, usually but not necessarily used for larger needlework projects have been mounted to upright standards or posts. Frequently, the opposite ends of such frames have been swingably mounted about the upright posts so that the needlework could be done from one side of the frame and thereafter the frame could be rotated to perform any cutting or knotting operations. Many of these previous structures, however, are such that it is necessary for a person doing the needlework to sit in a straightback chair or the like in order to have the working frame conveniently positioned.

Some examples of the prior art are the patents to Angus U.S. Pat. No. 104,685; States U.S. Pat. No. 347,743; Crawford U.S. Pat. No. 579,472; Meyer et al U.S. Pat. No. 2,318,877; Lamme U.S. Pat. No. 2,884,737; and Johnson et al U.S. Pat. No. 3,774,325.

SUMMARY OF THE INVENTION

The present invention is embodied in an apparatus for supporting a working frame used in fancywork. The apparatus includes a pair of generally upright standards which may be disposed at opposite ends of the working frame and swingably connected thereto when desired, or such upright standards may be located in side-by-side relationship and connected together by auxiliary apparatus which is connected to one end of the working frame so that the working frame may be cantilevered outwardly from the upright supports but is still capable of swinging movement along a plurality of axes.

It is an object of the invention to provide a support for a fancy stitchery working frame which can be either connected to opposite ends of the working frame or may be located in side-by-side relationship with each other and the working frame adjustably cantilevered therefrom.

DESCRIPTION OF THE PREFERRED EMBODIMENTS

Figure 2:
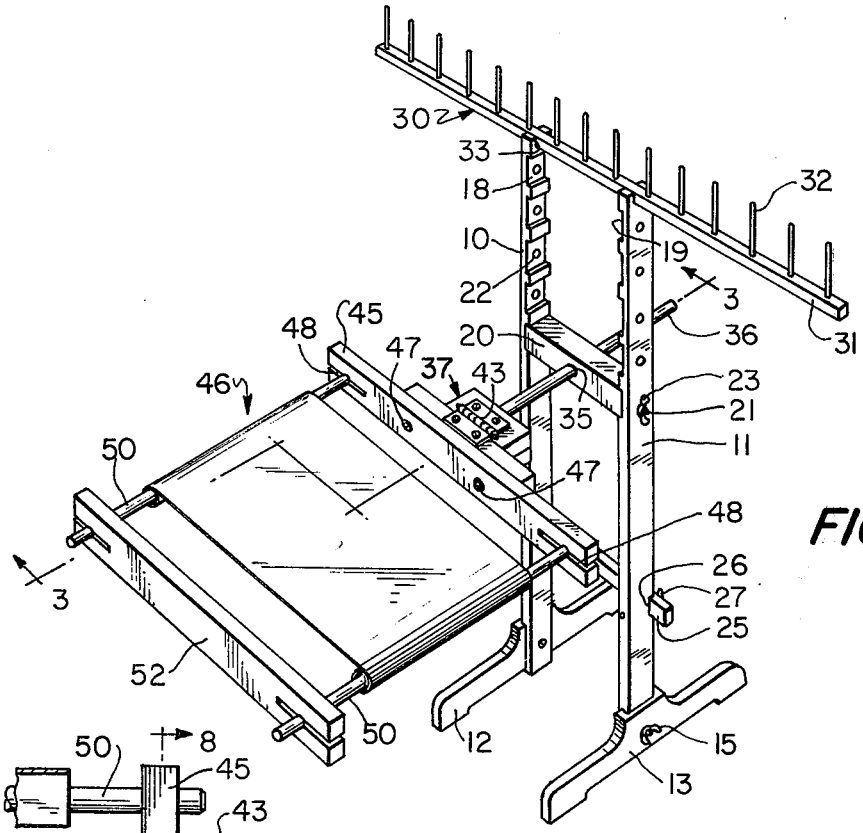
FIG. 2 is an enlarged perspective of the apparatus per se.

With further reference to the drawings, the embodiment of the invention includes a pair of upright posts 10 and 11 each of which is supported by a foot member 12 and 13, respectively, having a recess 12', 13' for receiving the lower ends of the posts and connected thereto by suitable fastening means 15. As viewed in FIG. 2, the outer surfaces 16, 17 of the posts are plain and the inner surfaces are provided with a series of spaced recesses or notch means 18, 19 for receiving a spacer member 20 between any oppositely disposed or facing pair of notches. In order to further secure the spacer member, a bolt means 21 extends from each end of the spacer member for reception in openings 22 within the notch portions of the post and are secured therein by wing nuts 23.

In order to afford greater stability of the upright posts, a cross member 25 is mounted in notches 26 which are formed in an edge adjacent to the lower ends of each post and secured by suitable fastening means 27.

A yarn sorter 30 having a cross bar 31 and a plurality of spaced fingers 32 may be mounted in the notches 33 at the upper ends of the upright posts and thereby be conveniently positioned for use while affording added stability to the support structure.

The spacer member 20 has a transverse horizontal opening or bore hole 35 which receives a dowel rod 36 or other rod means. As indicated in FIG. 3, the end of the dowel rod or rod means is received within a clamping member 37 having opposed clamping elements 38, spaced adjustable fastening elements 39 and central recess portions 40 which receive the end of the dowel rod 36.

Figure 3:
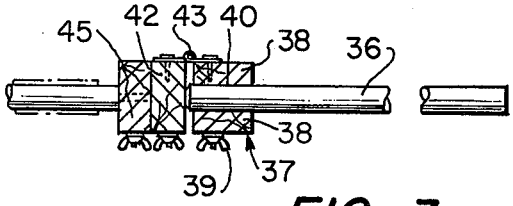
FIG. 3 is an enlarged fragmentary section on the line 3—3 of FIG. 2.

A support block or support means 42 is connected by a hinge 43 to the upper clamping element 38, the hinge permitting the block to be lifted but not permitting downward movement past the horizontal position illustrated in FIG. 3.

An end member 45 of a working frame 46 is connected to the support block 42 by suitable fastening means 47. The end member 45 of the working frame has the usual slotted recesses 48 adjacent to its ends for receiving spaced dowels 50 on which the tapestry or base material is wound; the other ends of the dowels being received in a second end member 52.

Figure 1:
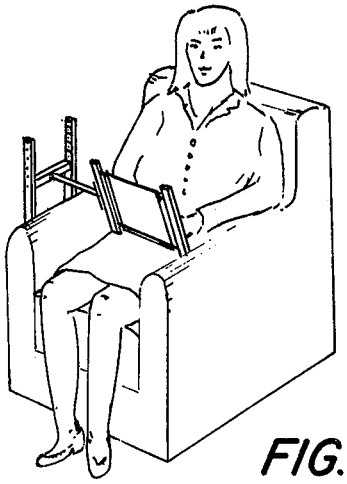
FIG. 1 is a perspective illustrating one application of the invention in use.

In the operation of the device which has been described, the height of the dowel rod 36 may be adjusted by selecting the recesses between which the spacer member 20 is mounted. The dowel rod 36 is frictionally received within the bore hole 35 thereby permitting angular adjustment about its axis to suit the desires of the user, as illustrated in FIG. 1. The working frame 46 may be moved out of the way of its user by rotating it about the hinge 43.

Figure 6:
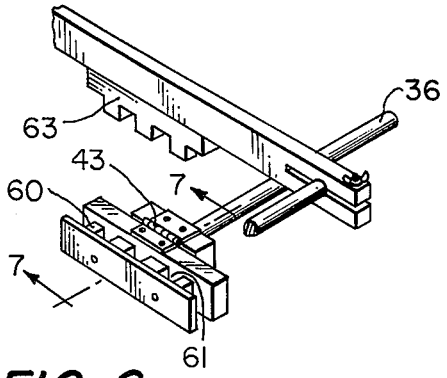
FIG. 6 is an exploded perspective of a modified support member.
Figure 7:
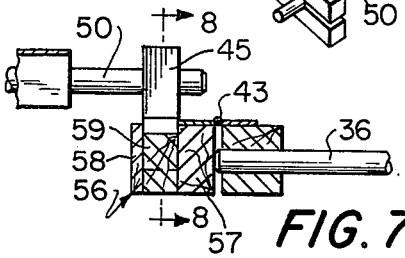
FIG. 7 is an enlarged section on the line 7—7 of FIG. 6.
Figure 8:
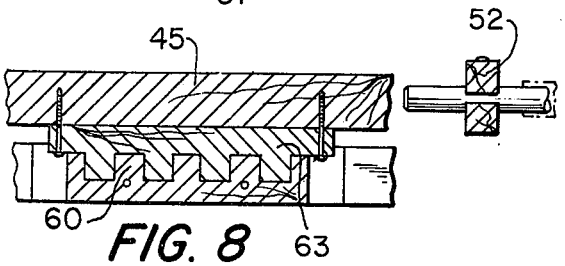
FIG. 8 is a section on the line 8—8 of FIG. 7.

In certain types of stitchery, it is necessary or desirable that the working frame be reversible from end to end. In order to facilitate such reversal, the invention includes the provision of a readily detachable mount for the working frame, as more particularly illustrated in FIGS. 6, 7 and 8. In this modification, the dowel rod 36 is connected to the clamping member 37 and leaf of hinge 43, as previously described. The other leaf of the hinge, however, is connected to a modified support block 56. The block 56 has spaced side members 57, 58 which are secured by an engaging member 59 having teeth 60 and slots 61 therebetween.

In order to accommodate either end member of the working frame, each of such working frame end members has attached thereto an engaging member or tooth member 63 which is of a size and configuration snugly to engage the toothed member 59 which is connected to the hinge 43. While a tooth type connection is illustrated, other types of easily removable connections are contemplated. This mounting connection permits relatively easy attachment of the working frame by either of its ends so that the same may be reversed as desired.

The application of the invention as described above is especially adapted for mounting a relatively small working frame for convenient use by a person sitting in a chair or extended over his bed, the mounting being a cantilever which can be rotated as well as swung up and down so that it may be easily moved out of the way.

The invention also provides for the mounting of a working frame which may be substantially larger. This application is accomplished by changing the arrangement of the supporting members to that illustrated in FIGS. 4 and 5. Thus in order to convert the support from that of FIG. 2 to that of FIG. 4, the spacer member 20 is removed together with the cross member 25 and the yarn sorter 30. Each post 10, 11 is then rotated 180° so that the smooth surfaces are facing each other and the posts are spaced apart a distance corresponding to the spacing of the end members 45′, 52′ of the working frame 46. The end members are provided with fastening members 65 centrally thereof which pass through oppositely disposed openings 22 at the desired height, such fastening members permitting angular adjustment and rotation of the working frame.

In order to add stability to the upright posts, an adjustable cross brace 70 is provided. The cross brace has end members 71 which are received in the slots 26 of the post and are connected by a member 72, the ends of member 72 and the free ends of members 71 being provided with slots and fastening members which permit longitudinal adjustment of the effective length of the cross brace 70.

The yarn sorter in this application is mounted in one of the recesses 19 and secured by fastening means 75.

Figure 5:
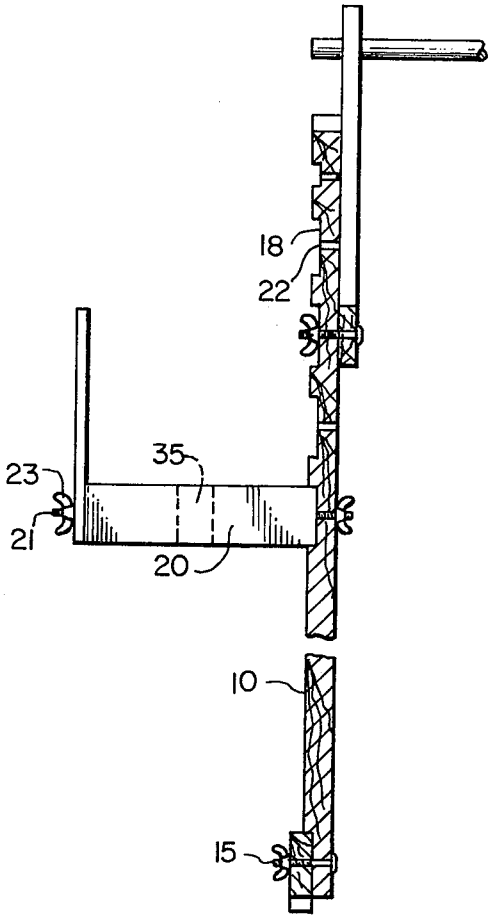
FIG. 5 is an enlarged fragmentary section on the line 5—5 of FIG. 4.
Figure 4:
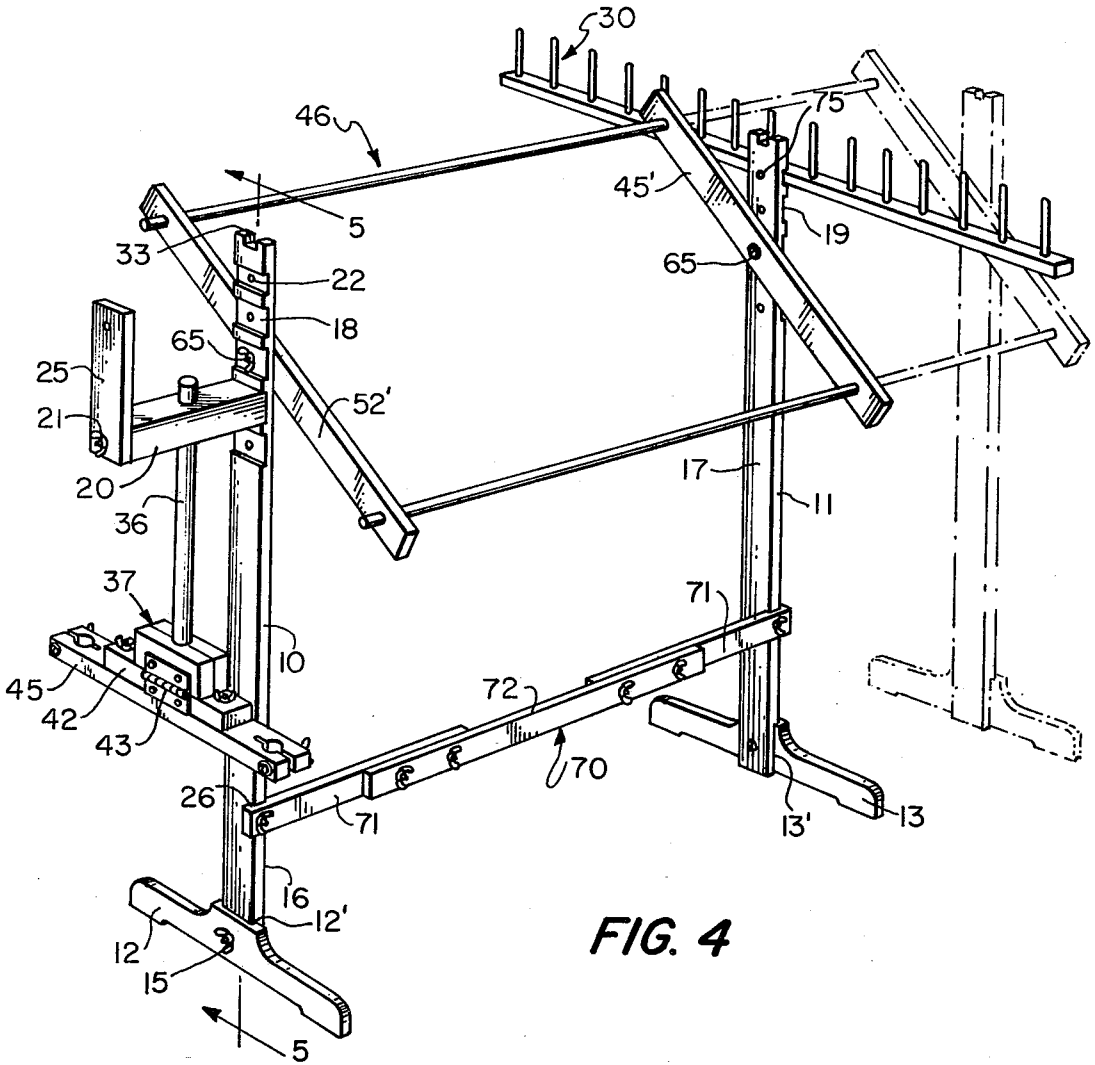
FIG. 4 is a perspective illustrating another application of the invention.

If desired, the cantilever support may be mounted on the outer sides of one of the posts, as illustrated in FIGS. 4 and 5. Thus an end of the spacer member 20 is received in an appropriate recess and secured thereto by the fastening means with the dowel rod 36 extending downwardly therefrom. A working frame may be mounted therein for storage or convenient reference as desired. An auxiliary support may be provided by connecting an end of the cross member 25 to the outer end of the spacer member by a fastening means 23.

In the application of the device as illustrated in FIGS. 4 and 5, a relatively large frame may be accommodated in such manner that it is convenient for working and it may be turned to the appropriate position as required.

The invention provides a relatively simple structure for alternative support of a working frame either by a cantilever arrangement or directly between upstanding posts, the support structure being readily interchangeable and adaptable for a variety of manners of use.

I claim:

1. An apparatus for adjustably supporting a fancywork frame in a plurality of positions, comprising a pair of upright posts, a spacer member, means for mounting the spacer member at a selected height between said posts, rod means carried by said spacer member and extending transversely thereof and being longitudinally and rotatably adjustable relative thereto, support means connected to said rod means, and means for mounting the fancywork frame on said support means, whereby said posts may be disposed in side-by-side relationship and the fancywork frame selectively cantilevered from the spacer member and angularly adjusted relative to said posts.

2. The invention of claim 1, said posts having first and second generally parallel surfaces, the first surface of each of said posts being relatively smooth and the second surface of at least one post having at least one notch means, whereby said spacer member may be selectively mounted in one of said notch means.

3. The invention of claim 2 in which said spacer member has an outwardly extending bolt at each end and said notch means has an opening for receiving a bolt.

4. The invention of claim 1 in which said spacer member has a transverse bore adapted snugly to receive said rod means.

5. The invention of claim 1 in which said support means includes an adjustable clamping member for engagement with said rod means.

6. The invention of claim 1 in which said means for mounting a working frame on said support means includes hinge means thereby permitting said working frame to be angularly positioned relative to said rod means.

7. The invention of claim 1 including yarn sorter means, and said posts having means for simultaneously engaging said yarn sorter means, whereby said yarn sorter means is effectively positioned and assists in maintaining the stability of the posts.

8. The invention of claim 1 in which said support means has a first engaging means, a second engaging means mounted at each end of the fancywork frame, whereby either end of the fancywork frame may be mounted on the support means.

9. The invention of claim 8 in which said first engaging means is a square tooth structure and said second engaging means is a complementary square tooth structure.

10. An apparatus for providing a working support for fancywork comprising a fancywork frame, support means for adjustably supporting said fancywork frame in a plurality of positions including first and second upright posts having upper and lower portions, said first and second posts having opposed facing surfaces having a plurality of vertically spaced openings adjacent their upper portions, said vertically spaced openings of said first post being in substantially horizontal alignment with said vertically spaced openings in said second post, and means for selectively mounting said fancywork frame in a pair of aligned openings in said posts, whereby said means for mounting said fancywork frame permit said frame to be angularly adjusted relative to said first and second posts.

11. The structure of claim 10 including extensible brace means disposed between said first and second posts, and means for mounting said brace means adjacent said lower portion of said first and second posts.

12. An apparatus for adjustably supporting a fancywork frame in a plurality of positions comprising a pair of upright posts having first and second generally parallel surfaces, the first surface of each of said posts being relatively smooth and the second surface having a plurality of recesses, each of said recesses having a bolt receiving hole extending through said post and providing an opening on the smooth side thereof, an elongated spacer means having an outwardly extending bolt carried by each end and adapted to be cooperatively received within aligned recesses of said posts when the recessed surfaces of said posts are in facing relationship with each other, said outwardly extending bolt of one end of said spacer means being selectively received in one of said openings along said first side of one of said upright posts when said posts are positioned with said first surfaces in facing relationship with each other, a bore hole extending through said spacer means generally normal to the longitudinal axis thereof, an elongated cylindrical dowel rod means, a support block hingedly connected to said clamp member, and means for mounting the working frame on said support block, whereby when said upright posts are positioned so that said first surfaces are in opposed facing relationship the fancywork frame may be supported at opposite ends between said upright posts and selectively when said upright posts are positioned with said second surfaces in opposed facing relationship, said posts may be disposed in side-by-side relationship with said spacer means extending between said aligned recesses and the fancywork frame may be cantilevered therefrom.

* * * * *